US010886649B1

(12) United States Patent
Yang et al.

(10) Patent No.: US 10,886,649 B1
(45) Date of Patent: Jan. 5, 2021

(54) CABLE CONNECTOR AND CONNECTOR ASSEMBLY

(71) Applicant: Amphenol AssembleTech(Xiamen) Co., Ltd, Xiamen (CN)

(72) Inventors: Wenchu Yang, Xiamen (CN); Hui Tang, Xiamen (CN); Yinghao Ke, Xiamen (CN); Zhenxing Liu, Xiamen (CN); Hang Li, Xiamen (CN)

(73) Assignee: Amphenol AssembleTech(Xiamen) Co., Ltd, Xiamen (CN)

( * ) Notice: Subject to any disclaimer, the term of this patent is extended or adjusted under 35 U.S.C. 154(b) by 0 days.

(21) Appl. No.: 16/746,987

(22) Filed: Jan. 20, 2020

(30) Foreign Application Priority Data

Nov. 7, 2019 (CN) ..... 2019 1 1083793

(51) Int. Cl.
*H01R 12/75* (2011.01)
*H01R 13/627* (2006.01)

(52) U.S. Cl.
CPC ..... *H01R 12/75* (2013.01); *H01R 13/6273* (2013.01)

(58) Field of Classification Search
CPC ..... H01R 12/75; H01R 13/627
See application file for complete search history.

(56) References Cited

U.S. PATENT DOCUMENTS 6,655,979 B1 * 12/2003 Lee ..... H01R 13/6275 439/357
6,860,750 B1 * 3/2005 Wu ..... H01R 13/6275 439/357
7,083,459 B1 * 8/2006 Wu ..... H01R 13/6275 439/354
7,581,978 B1 * 9/2009 Briant ..... H01R 13/6275 439/358
10,630,022 B2 * 4/2020 Yang ..... H01R 13/627
2005/0101176 A1 * 5/2005 Kachlic ..... H01R 13/6275 439/352
2013/0052851 A1 * 2/2013 Wang ..... H01R 13/6275 439/345
2015/0229075 A1 * 8/2015 Lin ..... H01R 13/6272 439/153
2020/0076132 A1 * 3/2020 Yang ..... H01R 12/7064

* cited by examiner

*Primary Examiner* — Briggitte R. Hammond
(74) *Attorney, Agent, or Firm* — Bayramoglu Law Offices LLC

(57) ABSTRACT

A cable connector includes a cable-end insulating main body, a cable-end conductive terminal group provided inside the cable-end insulating main body, a cable electrically connected to the cable-end conductive terminal group, and a buckle installed above the cable-end insulating main body. The cable-end insulating main body includes a main body portion, an insertion portion formed by extending forward from the main body portion, and a buckle portion formed by extending upward and forward from an upper surface of the main body portion. A buckle slot is provided on the top of the buckle portion, the buckle is installed in the buckle slot, a first plug slot is provided in the insertion portion, the cable-end conductive terminal group is provided in the first plug slot, and a first limit slot is provided between a portion of the buckle portion extending out the main body portion and the insertion portion.

20 Claims, 15 Drawing Sheets

CABLE CONNECTOR AND CONNECTOR ASSEMBLY

CROSS REFERENCE TO THE RELATED APPLICATIONS

This application is based upon and claims priority to Chinese Patent Application No. 201911083793.7, filed on Nov. 7, 2019, the entire contents of which are incorporated herein by reference.

TECHNICAL FIELD

The present invention relates to the technical field of connectors, and in particular to a cable connector and a connector assembly.

BACKGROUND

Conventional printed circuit boards (PCB) have significant limitations with increasing signal transmission speeds in servers and switches, especially speeds reaching upwards of 56 Gbps and 112 Gbps. Connectors are required with PCBs at high signal transmission speeds because without connectors, PCBs have high signal attenuation which degrades signal integrity. Connectors help reduce the signal attenuation.

Current connector products are relatively large in size, and are therefore not suitable for using near a server chip. Generally, it is desired to have efficient use of space near a motherboard to reduce cost and to make full use of a space under the radiator. It is desirable therefore that the connector products are relatively smaller in height so that the products can be placed under the radiator and closer to the radiator resulting in a complete use of the motherboard space of the server.

SUMMARY

In view of the above problems, an objective of the present invention is to provide a cable connector and a connector assembly that can fit under the radiator of a server, thereby saving space around the motherboard.

In order to achieve the above objective of the invention, the present invention adopts the following technical solutions: a cable connector including a cable-end insulating main body, a cable-end conductive terminal group provided inside the cable-end insulating main body, a cable electrically connected to the cable-end conductive terminal group, and a buckle installed above the cable-end insulating main body. The cable-end insulating main body includes a main body portion, an insertion portion formed by extending forward from the main body portion, and a buckle portion formed by extending upward and forward from the upper surface of the main body portion. A buckle slot is provided on the top of the buckle portion, the buckle is installed in the buckle slot. A first plug slot is provided in the insertion portion, the cable-end conductive terminal group is provided in the first plug slot. A first limit slot is provided between the portion of the buckle portion extending out the main body portion and the insertion portion.

Further, the buckle portion protrudes forward beyond the insertion portion.

Further, under the insertion portion, two guide positioning posts are formed by extending forward from the front end face of the main body portion, and a second limit slot is provided between the insertion portion and the guide positioning post.

Further, the guide positioning post protrudes forward beyond the insertion portion.

Further, a cavity is provided inside the main body portion, a plastic fixing member for fixing a tail end of the cable-end conductive terminal group is fixedly provided in the cavity, and the cable-end conductive terminal group stretches forward into the first plug slot.

Further, the cable-end conductive terminal group includes a first conductive terminal group and a second conductive terminal group, the first conductive terminal group and the second conductive terminal group are respectively arranged on the upper surface and the lower surface of the first plug slot. The cable includes a first cable and a second cable provided parallel to each other, the first cable is electrically connected to the first conductive terminal group, and the second cable is electrically connected to the second conductive terminal group.

In an embodiment, both the first cable and the second cable penetrate backward from the rear end of the main body portion.

In another embodiment, one end of the first conductive terminal group, connected to the plastic fixing member, is bent downward to form a first connection portion, and one end of the second conductive terminal group, connected to the plastic fixing member, is bent downward to form a second connection portion. The first connection portion and the second connection portion are provided parallel to each other and staggered back and forth, and both the first cable and the second cable penetrate downward from the bottom of the main body portion.

Further, the distance between the first connection portion and the second connection portion is 0.3 mm to 1.5 mm.

Further, a drawstring is further included. The buckle includes a fixing portion, an elastic portion formed by bending upward from one end of the fixing portion and a pressing portion formed by obliquely extending upward from the tail end of the elastic portion. The fixing portion is fixed in the buckle slot, and one end of the drawstring is connected to the pressing portion.

Further, a rear cover is provided at the rear end of the main body portion, a drawstring hole is provided at the upper part of the rear cover, and one end of the drawstring passes through the drawstring hole and is connected to the pressing portion of the buckle.

The present invention also provides a connector assembly including a cable connector and a board-end connector, the cable connector is the cable connector described above.

Further, the board-end connector includes a board-end insulating main body, a board-end conductive terminal group fixed inside the board-end insulating main body, and a housing sleeved outside the board-end insulating main body. A second plug slot is provided inside the board-end insulating main body, the top of the housing is bent to form a neck, the insertion portion and the front end of the buckle portion of the cable connector are inserted into the second plug slot and the neck, respectively, and the top board of the board-end insulating main body is inserted into the first limit slot.

Further, an insulating plug board for inserting into the first plug slot is provided inside the second plug slot, the board-end conductive terminal group includes a conductive plastic strip, a third conductive terminal group, and a fourth conductive terminal group. The conductive plastic strip is installed inside the insulating plug board in an embedded manner, the third conductive terminal group and the fourth conductive terminal group are respectively arranged at the upper surface and the lower surface of the insulating plug board, both the third conductive terminal group and the fourth conductive terminal group are respectively formed by alternately arranging a ground terminal and a signal terminal pair in order, the signal terminal pair is composed of two mutually symmetrical signal terminals, and all the ground terminals are electrically connected to the conductive plastic strip.

Further, the height of the insulating plug board is less than or equal to the height of the first plug slot, and a gap for inserting a side wall of the insertion portion is formed between the insulating plug board and the side wall of the board-end insulating main body.

Further, in order to increase the strength of the entire housing and prevent the sides of the housing from easily deforming, two fixing arms extending toward the side far from the cable connector are respectively provided on both sides of the housing and both sides of the neck.

Further, the two sides of the housing respectively extend toward one side of the cable connector and form two L-shaped limit boards for limiting the left and right of the cable connector.

Specifically, the top of the housing is formed with a first U-shaped groove at the front end of the neck, the rear end of the buckle portion of the cable connector is accommodated in the first U-shaped groove. The front end of the bottom of the housing is formed with a second U-shaped groove, the main body portion of the cable connector is accommodated in the second U-shaped groove, and the cable connector is completely inserted into the housing. This structure can effectively reduce the total height of the product after assembly and can also improve the contact reliability of the product.

Further, under the insertion portion, two guide positioning posts are formed by extending forward from the front end face of the main body portion, the bottom of the housing is bent to form two guide holes for inserting the guide positioning posts. The second limit slot is provided between the bottom of the insertion portion and the top of the guide positioning post, and the bottom board of the board-end insulating main body is inserted into the second limit slot.

Further, the side and bottom of the housing are respectively provided with a lockhole and an elastic sheet, and the side and bottom of the board-end insulating main body are respectively provided with a locking block and an elastic sheet slot for engaging with the lockhole and the elastic sheet in a locking manner.

The present invention has the following advantages: 1. The present invention provides a product with a transmission speed up to 56 Gbps and 112 Gbps, which meets the customer's requirements for the signal integrity of the product. The cable connector can be fully inserted into the board-end connector, so that the overall height of the connector assembly is less than 8 mm, which can be used under a radiator of a server to save motherboard space; 2. Providing a guide positioning post and a guide hole can guide the cable connector and can also prevent the product from being twisted and skewed by a force, which improves the reliability of the product; 3. The distance between a first connection portion and a second connection portion of a cable-end conductive terminal group is set to 0.3 mm to 1.5 mm, which is convenient for welding two rows of cables and improving the signal integrity of the product; 4. The top of a housing forms a first U-shaped groove at the front end of a neck, the rear end of a buckle portion is accommodated in the first U-shaped groove, a second U-shaped groove is formed at the front end of the bottom of the housing, and the main body portion of the cable connector is accommodated in the second U-shaped groove. This structure can effectively reduce the total height and size of the product after assembly and can also improve the contact reliability of the product.

Figure 1:
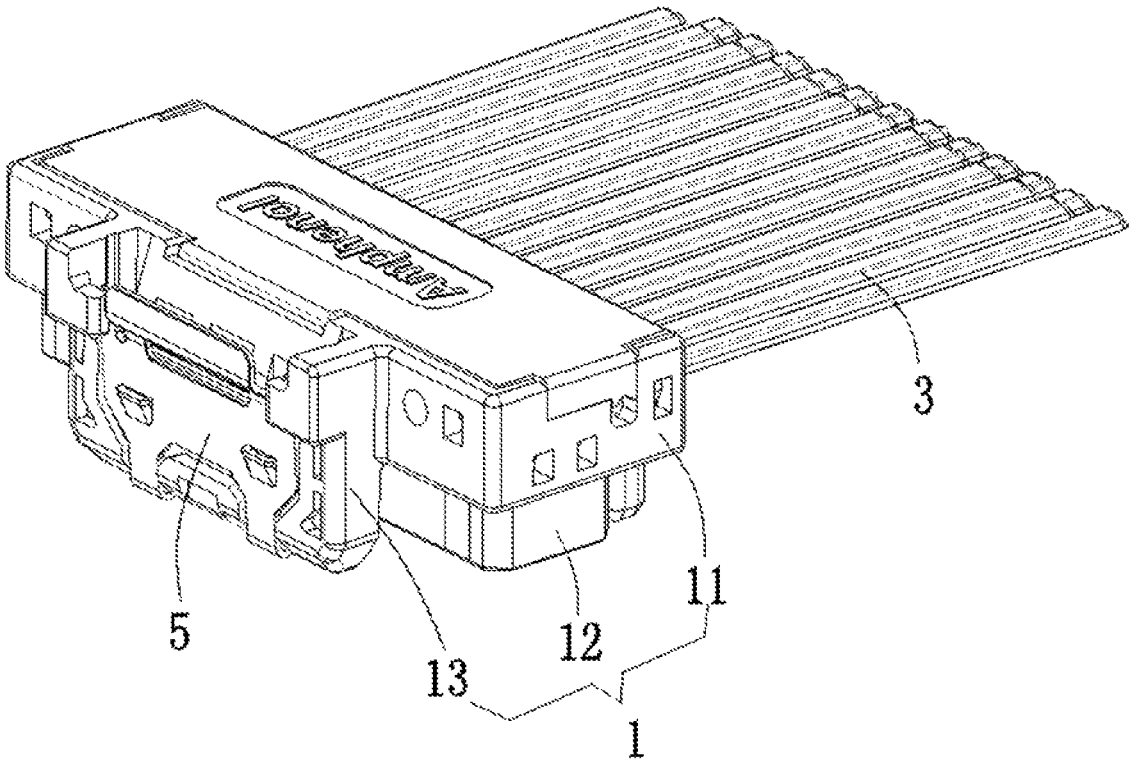
FIG. 1 is a perspective view showing the structure of the cable connector in Embodiment 1.
Figure 2:
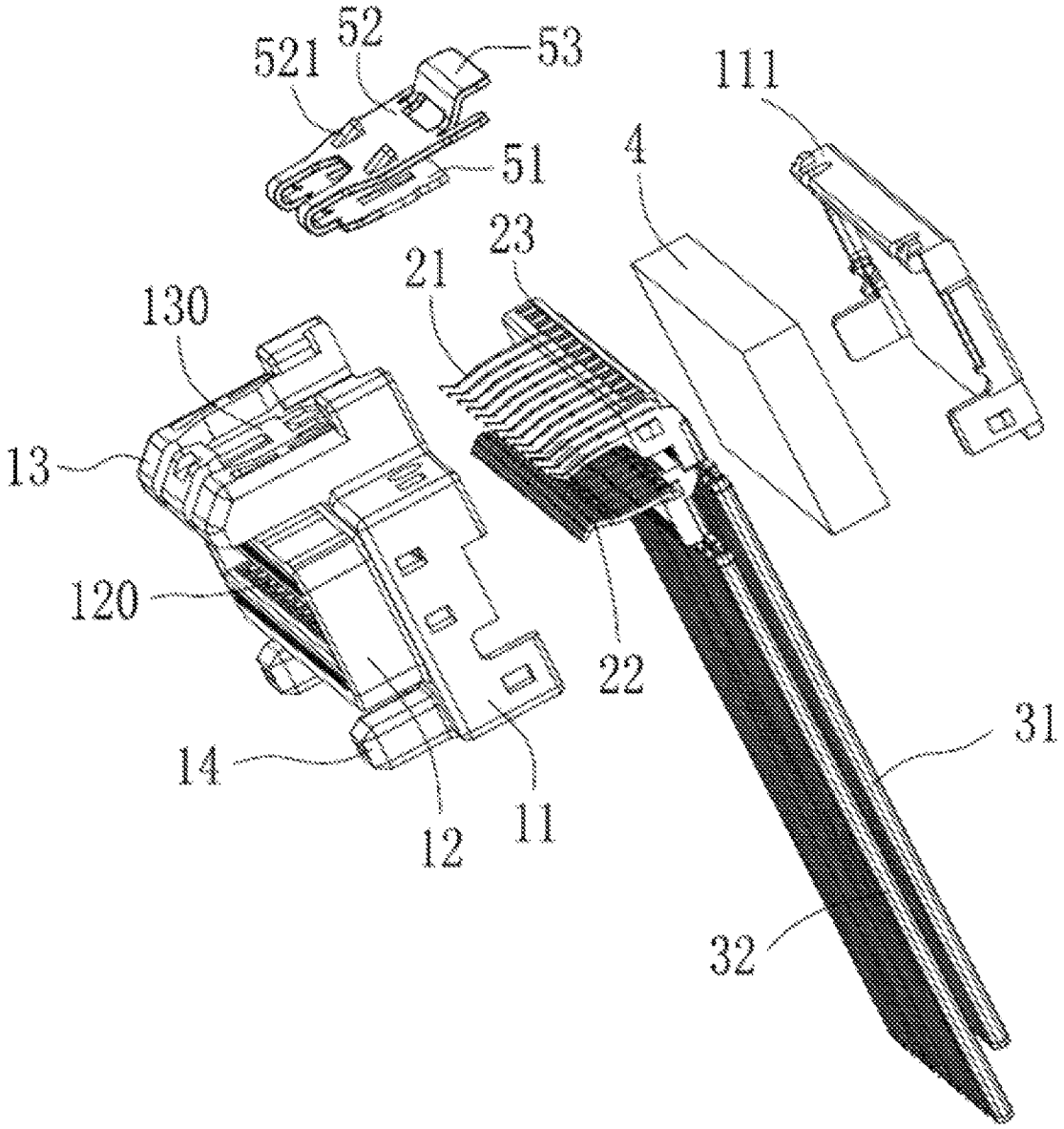
FIG. 2 is an exploded view of parts of FIG. 1.
Figure 3:
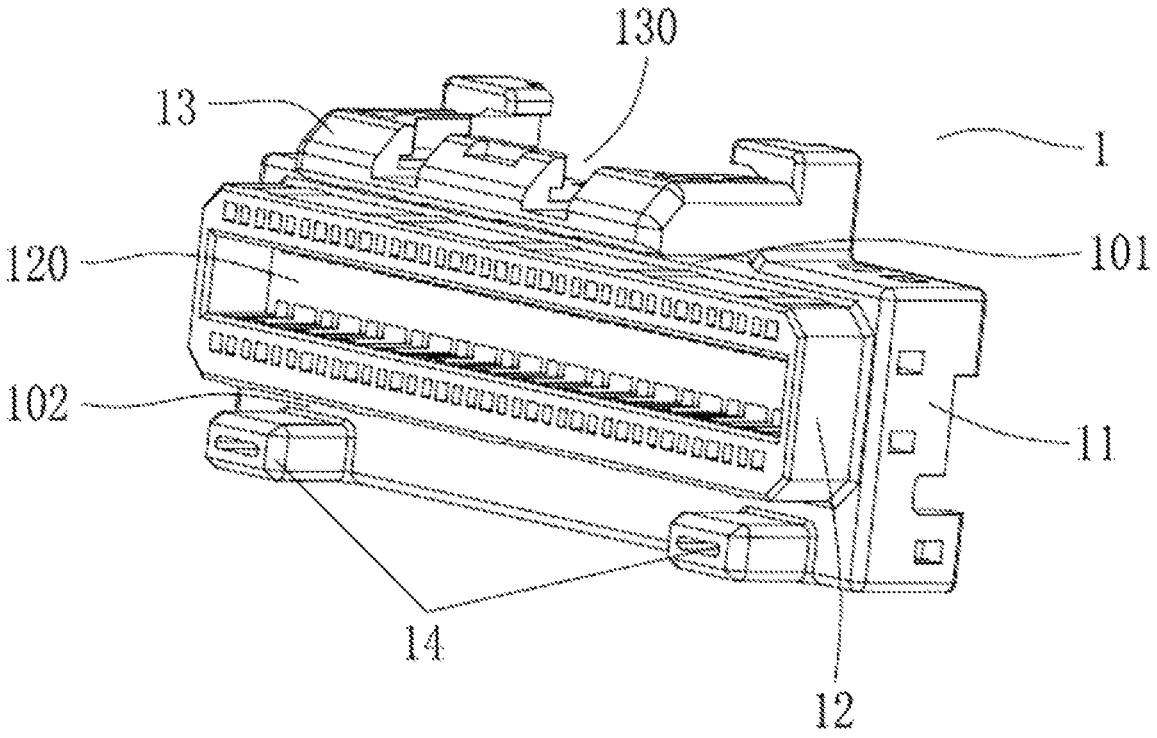
FIG. 3 is a perspective view showing the structure of the cable-end insulating main body.
Figure 4:
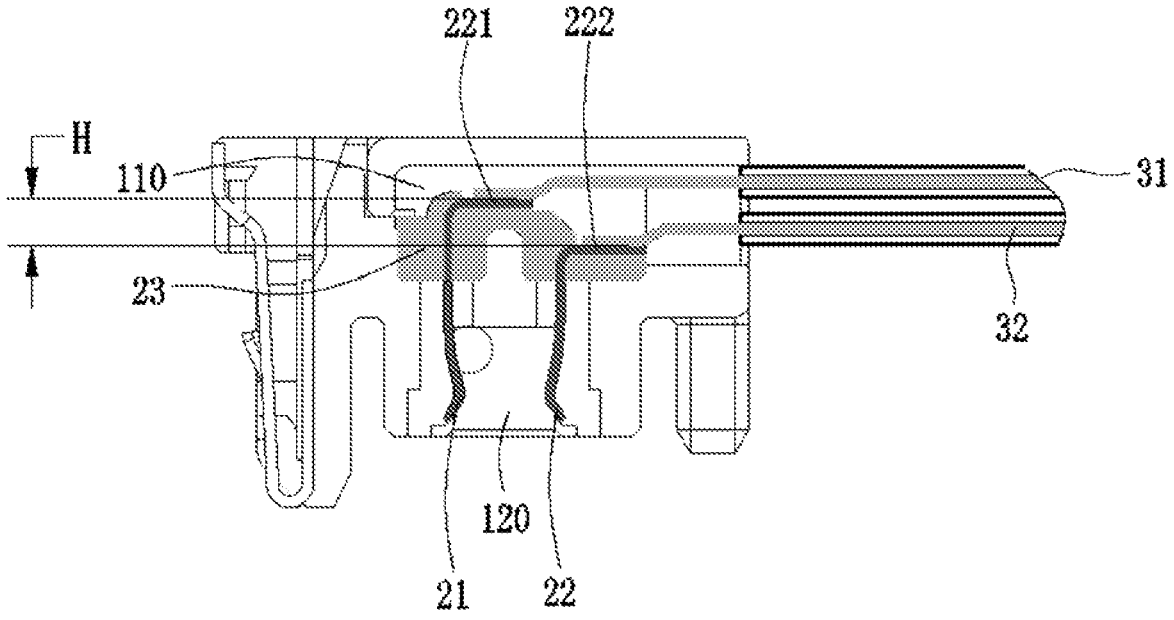
FIG. 4 is an installation schematic diagram of the cable-end conductive terminal group in Embodiment 1.

Description of main components: 1. cable-end insulating main body; 101. first limit slot; 102. second limit slot; 11. main body portion; 110. cavity; 111. rear cover; 112. drawstring hole; 12. insertion portion; 120. first plug slot; 13. buckle portion; 130. buckle slot; 14. guide positioning post; 201. ground terminal; 202. signal terminal; 21. first conductive terminal group; 211. first connection portion; 22. second conductive terminal group; 221. second connection portion; 23. plastic fixing member; 3. cable; 31. first cable; 32. second cable; 4. inner mold; 5. buckle; 51. fixing portion; 52. elastic portion; 521. locking protrusion; 53. pressing portion; 6. drawstring; 7. board-end insulating main body; 701. locking block; 702. elastic sheet slot; 71. second plug slot; 72. insulating plug board; 8. board-end conductive terminal group; 801. ground terminal; 802. signal terminal; 81. conductive plastic strip; 82. third conductive terminal group; 83. fourth conductive terminal group; 9. metal housing; 90. first U-shaped groove; 900. second U-shaped groove; 901. lock-hole; 902. elastic sheet; 91. neck; 92. guide hole; 93. locking hole; 94. fixing arm; 95. L-shaped limit board; H: distance between the first connection portion and the second connection portion; A: width of the ground terminal; B: width of the signal terminal; a: gap between the ground terminal and the signal terminal; b: gap between the signal terminal and the signal terminal.

DETAILED DESCRIPTION OF THE EMBODIMENTS

The present invention is further described below with reference to the drawings and specific embodiments.

Embodiment 1

As shown in FIGS. 1-4, a cable connector includes the cable-end insulating main body 1, a cable-end conductive terminal group, the cable 3, the inner mold 4, and the buckle 5. The cable-end insulating main body 1 includes the main body portion 11, the insertion portion 12 formed by extending forward from the front end face of the main body portion 11, and the buckle portion 13 formed by extending upward and forward from the upper surface of the main body portion 11. The first limit slot 101 is provided between the portion of the buckle portion 13 extending out the main body portion 11 and the insertion portion 12. The buckle slot 130 for installing the buckle 5 is provided on the top of the buckle portion 13. The first plug slot 120 is provided at the front end of the insertion portion 12. The cable-end conductive terminal group is provided in the first plug slot 120.

Preferably, the buckle portion 13 protrudes forward beyond the insertion portion 12.

Preferably, the front end face of the main body portion 11 has two guide positioning posts 14 extending forward under the insertion portion 12. The second limit slot 102 is provided between the bottom of the insertion portion 12 and the top of the guide positioning post 14. The guide positioning post 14 protrudes forward beyond the insertion portion 12.

The buckle 5 includes the fixing portion 51, the elastic portion 52 formed by bending upward from one end of the fixing portion 51, and the pressing portion 53 formed by obliquely extending upward from the tail end of the elastic portion 52. The fixing portion 51 is fixed in the buckle slot 130. The cavity 10 is provided inside the main body portion 11. The main body portion 11 is provided with the rear cover 111 at the rear end of the cavity 110, and the rear cover 111 is fixed on the main body portion 11 by the buckle.

The cable-end conductive terminal group includes the first conductive terminal group 21, the second conductive terminal group 22, and the plastic fixing member 23. The plastic fixing member 23 is provided in the cavity 110. The plastic fixing member 23 can be divided into two fixing members (i.e., an upper fixing member and a lower fixing member), and can also be an integral fixing member. The same ends of the first conductive terminal group 21 and the second conductive terminal group 22 are respectively fixed on the plastic fixing members 23, and the other ends thereof stretch into the first plug slot 120 and are respectively arranged on the upper surface and the lower surface of the first plug slot 120.

One end connected to the plastic fixing member 23 of the first conductive terminal group 21 is bent downward to form the first connection portion 211, and one end connected to the plastic fixing member 23 of the second conductive terminal group 22 is bent downward to form the second connection portion 221. The first connection portion 211 and the second connection portion 221 are provided parallel to each other and staggered back and forth. Preferably, the distance H between the first connection portion 211 and the second connection portion 221 is 0.3 mm to 1.5 mm. The cable 3 includes the first cable 31 and the second cable 32. The first cable 31 is welded to the first connection portion 211, and the second cable 32 is welded to the second connection portion 221. Both the first cable 31 and the second cable 32 penetrate downward from the bottom of the main body portion 11. The inner mold 4 is provided in the cavity 110 and completely covers the welding points of the first cable 31 and the first connection portion 211 and the welding points of the second cable 32 and the second connection portion 221.

Figure 13:
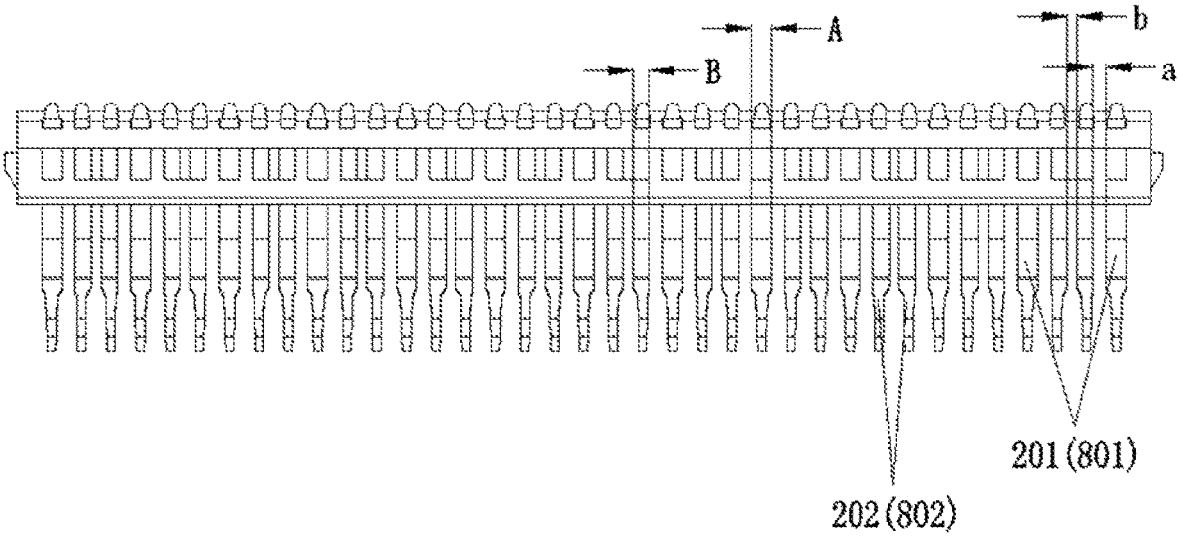
FIG. 13 is a schematic diagram showing the arrangement of conductive terminals of the cable-end conductive terminal group or the board-end conductive terminal group.

As shown in FIG. 13, both the first conductive terminal group 21 and the second conductive terminal group 22 are respectively formed by alternately arranging the ground terminal 201 and a signal terminal pair in order, and the signal terminal pair is composed of two mutually symmetrical signal terminals 202.

Preferably, the width A of the ground terminal 201 is greater than or equal to the width B of the signal terminal 202, and the gap a between the ground terminal 201 and the signal terminal 202 is greater than or equal to the gap b between the two signal terminals 202.

Embodiment 2

Figure 5:
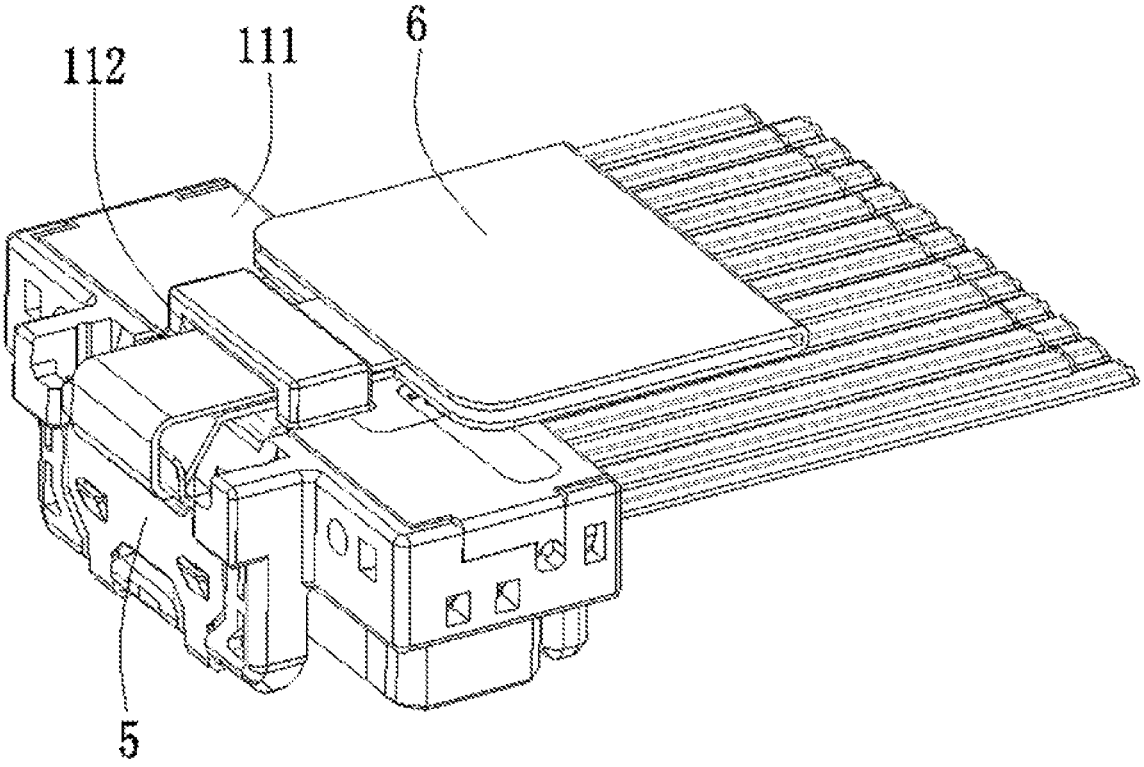
FIG. 5 is a perspective view showing the structure of the cable connector in Embodiment 2.

As shown in FIG. 5, the differences between this embodiment and Embodiment 1 are only that the cable connector further includes the drawstring 6, the drawstring hole 112 is provided at the upper part of the rear cover 111, and one end of the drawstring 6 passes through the drawstring hole 112 and is connected to the pressing portion 53 of the buckle 5. The remaining structures of this embodiment are the same as those of Embodiment 1.

Embodiment 3

Figure 6:
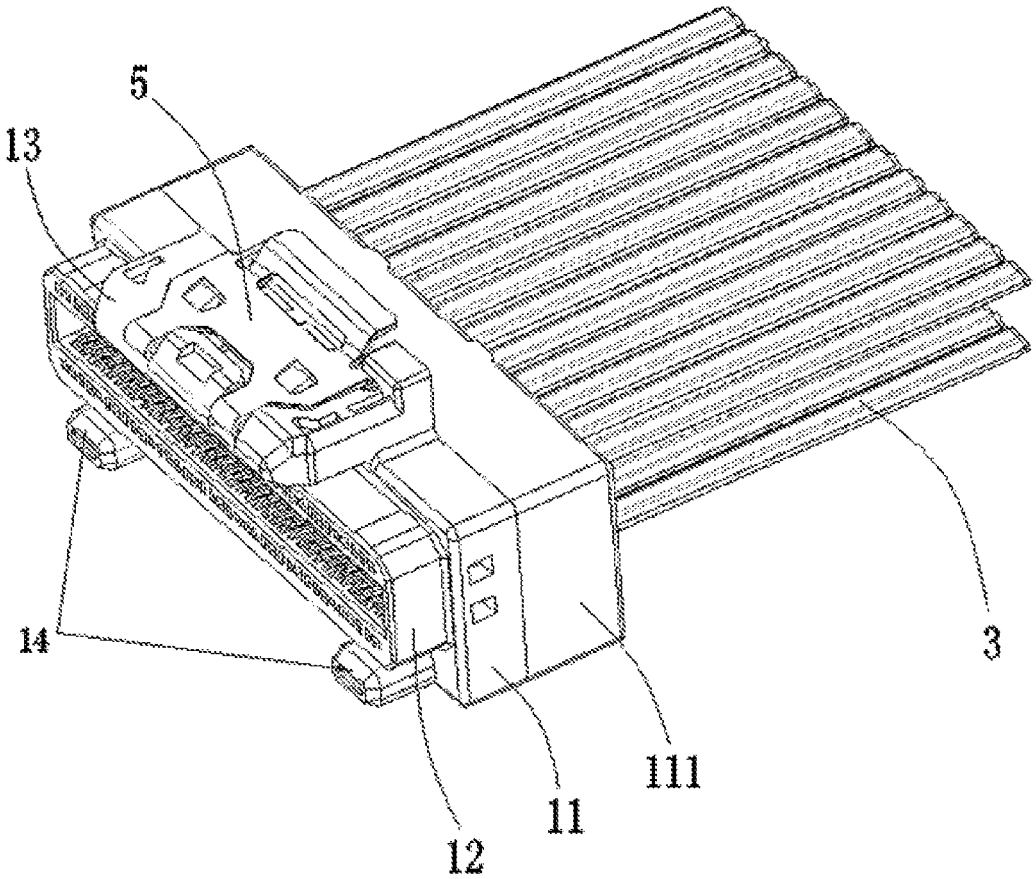
FIG. 6 is a perspective view showing the structure of the cable connector in Embodiment 3.
Figure 7:
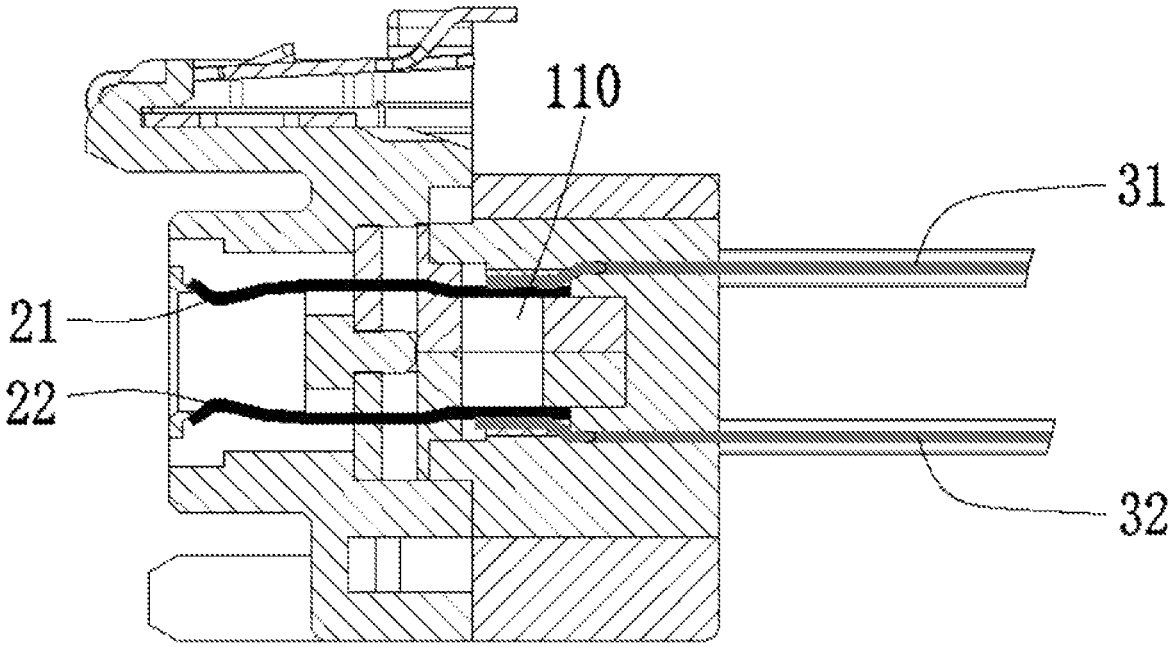
FIG. 7 is an installation schematic diagram of the cable-end conductive terminal group in Embodiment 3.

As shown in FIGS. 6 and 7, the differences between this embodiment and Embodiment 1 are only that the ends connected to the plastic fixing member 23 of the first conductive terminal group 21 and the second conductive terminal group 22 are not bent to form the connection portions. The first cable 31 is welded to the side of the first conductive terminal group 21 near the plastic fixing member 23, and the second cable 32 is welded to the side of the second conductive terminal group 22 near the plastic fixing member 23. Both the first cable 31 and the second cable 32 penetrate backward from the rear cover 111. The remaining structures of this embodiment are the same as those of Embodiment 1.

Embodiment 4

Figure 8:
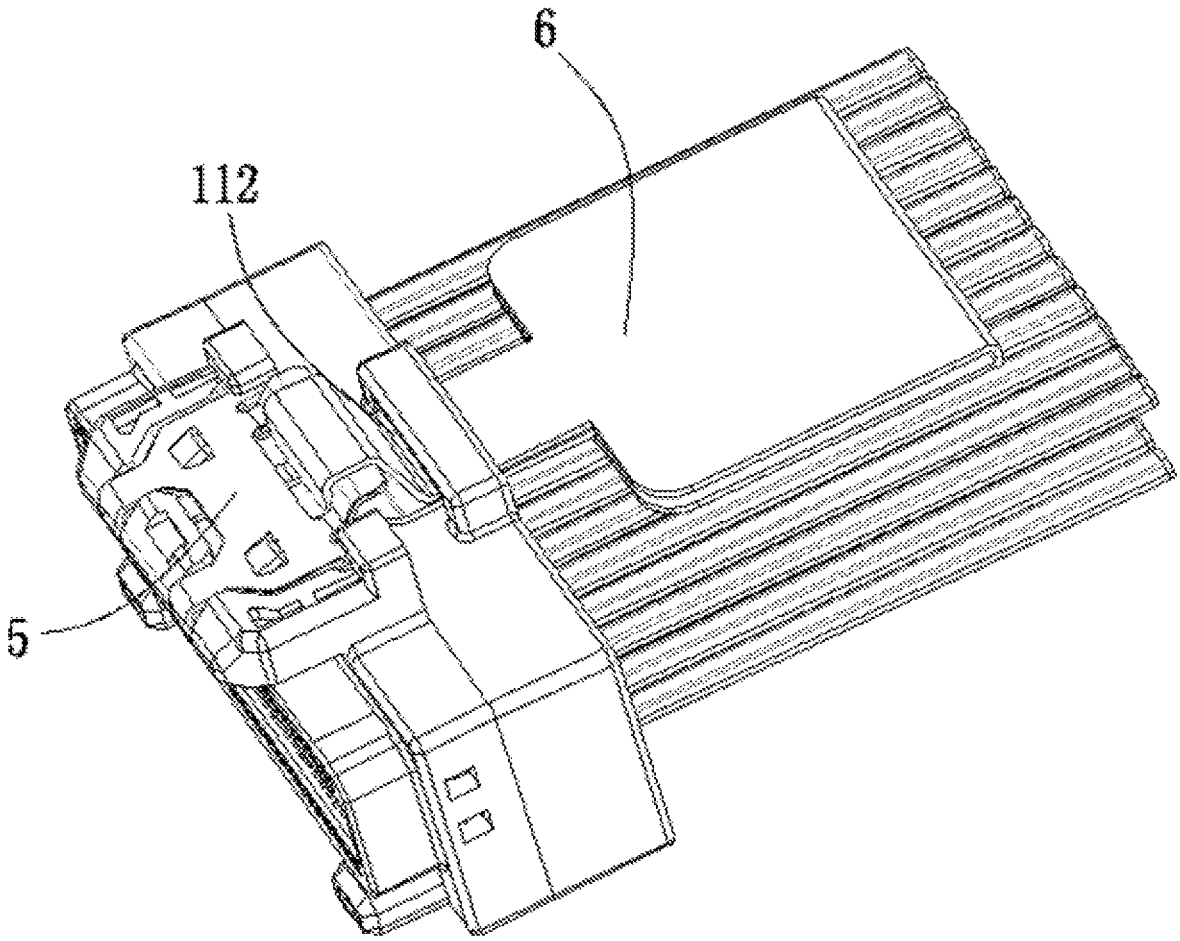
FIG. 8 is a perspective view showing the structure of the cable connector in Embodiment 4.
Figure 9:
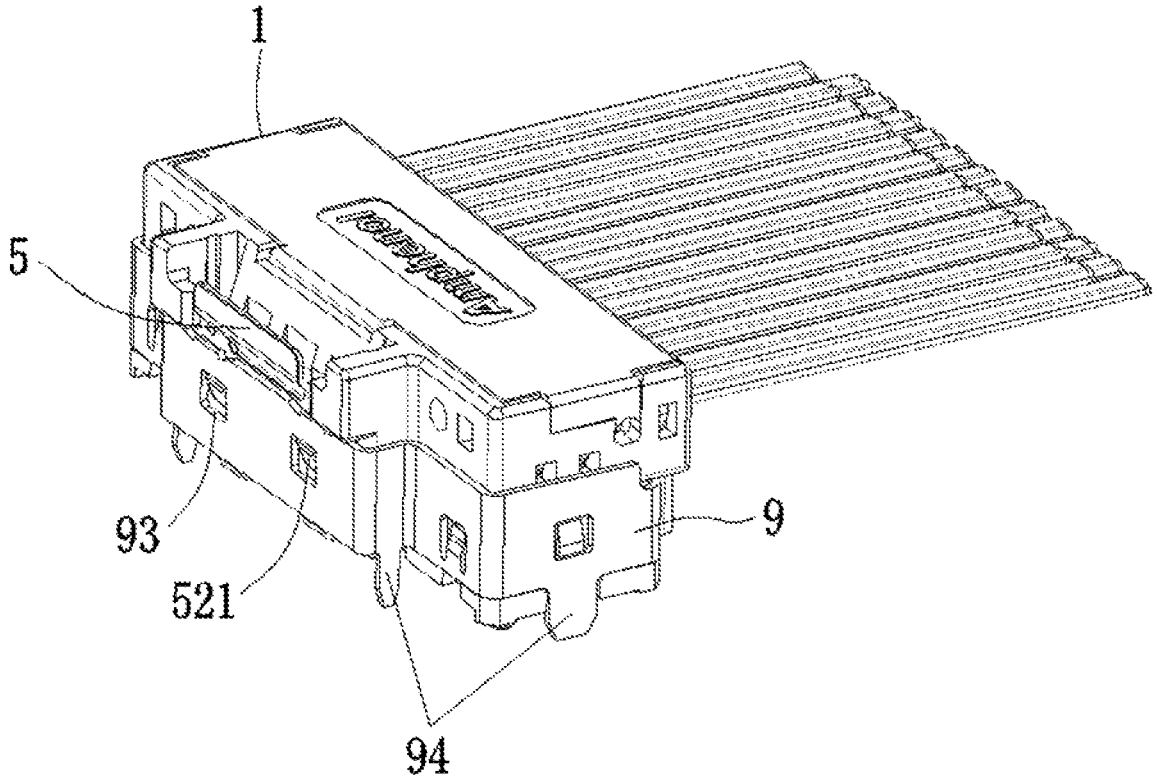
FIG. 9 is a perspective view showing the structure of the connector assembly in Embodiment 5.
Figure 10:
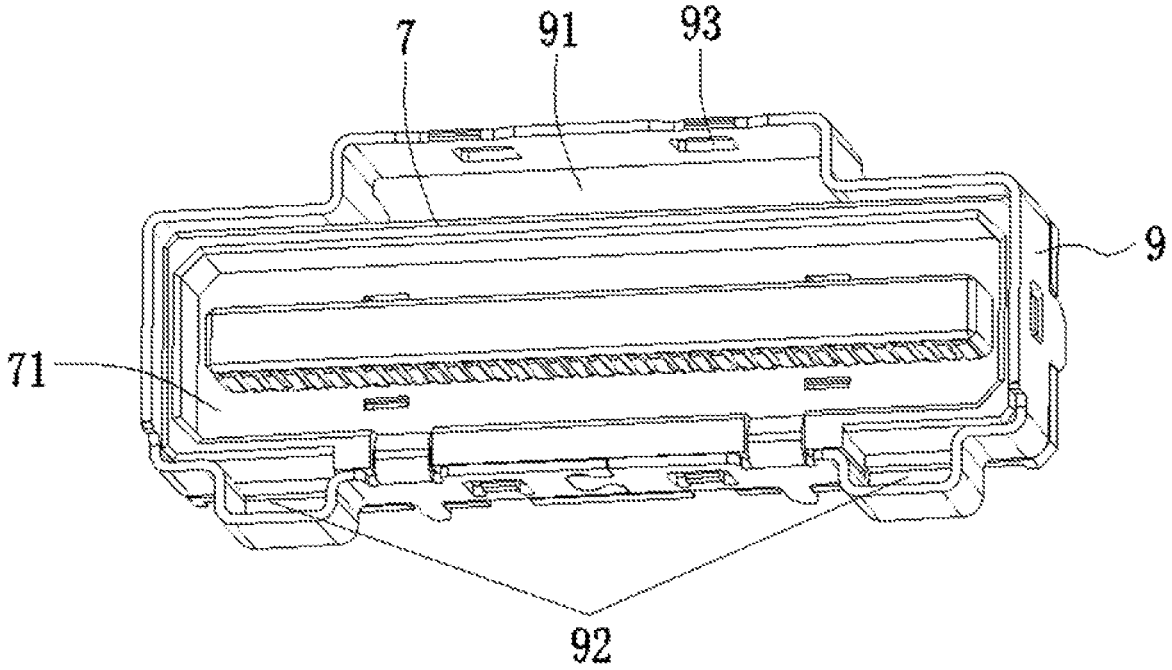
FIG. 10 is a perspective view showing the structure of the board-end connector in Embodiment 5.
Figure 11:
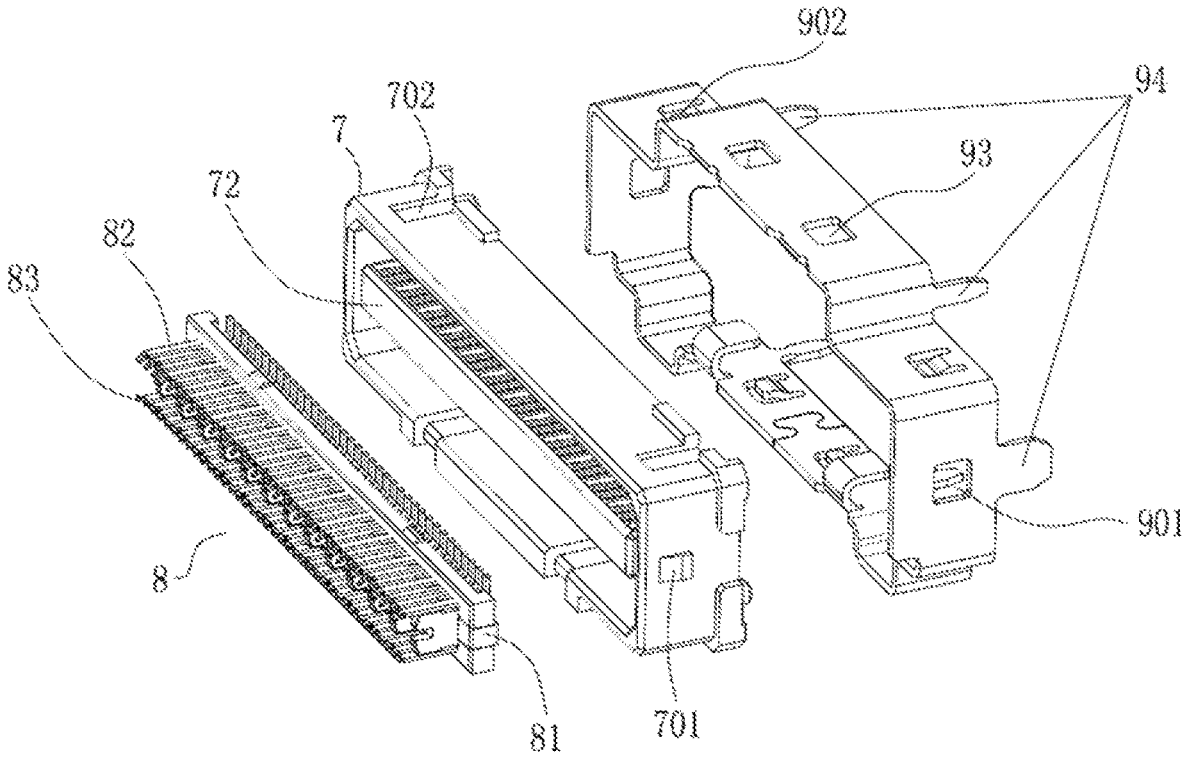
FIG. 11 is an exploded view of parts of FIG. 9.
Figure 12:
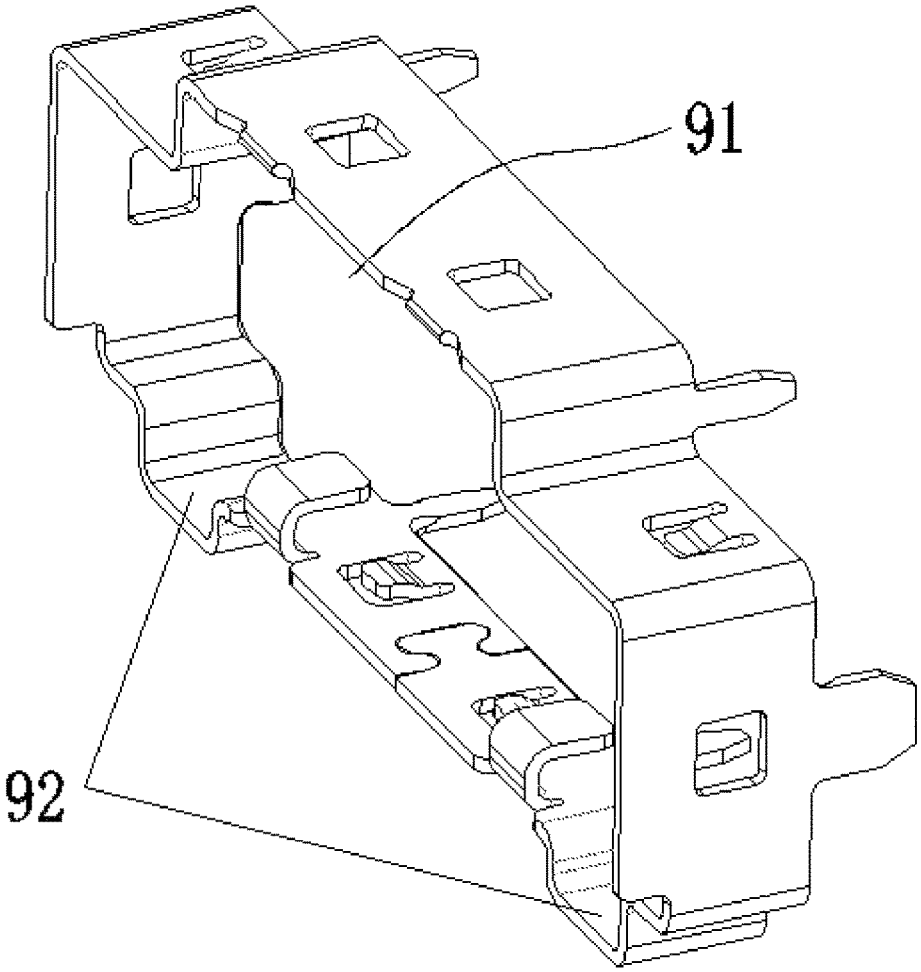
FIG. 12 is a perspective view showing the structure of the metal housing in Embodiment 5.

As shown in FIG. 8, the differences between this embodiment and Embodiment 3 are only that the cable connector further includes the drawstring 6, the drawstring hole 112 is provided at the upper part of the rear cover 111, and one end of the drawstring 6 passes through the drawstring hole 112 and is connected to the pressing portion 53 of the buckle 5. The remaining structures of this embodiment are the same as those of Embodiment 3.

Embodiment 5

As shown in FIG. 9-12, a connector assembly includes a cable connector and a board-end connector. The cable connector is the cable connector in Embodiment 1.

The board-end connector includes the board-end insulating main body 7, the board-end conductive terminal group 8 fixed inside the board-end insulating main body 7, and the metal housing 9 sleeved on the outer side of the board-end insulating main body 7. The board-end insulating main body 7 is made of plastic. The side and bottom of the metal housing 9 are respectively provided with the lockhole 901 and the elastic sheet 902, and the side and bottom of the board-end insulating main body 7 are respectively provided with the locking block 701 and the elastic sheet slot 702 for engaging with the lockhole 901 and the elastic sheet 902 in a locking manner.

The second plug slot 71 matching the shape of the insertion portion 12 is provided inside the board-end insulating main body 7, the insertion portion 12 is inserted into the second plug slot 71, and the top arm of the board-end insulating main body 7 is inserted into the first limit slot 101 between the buckle portion 13 and the insertion portion 12. The top of the metal housing 9 is bent to form the neck 91, and the bottom of the metal housing 9 is bent to form two guide holes 92 for inserting the guide positioning posts 14. The buckle 5 is provided with two locking protrusions 521 on the top of the elastic portion 52, and the metal housing 9 is provided with the locking holes 93 for locking with the two locking protrusions 521 on the top of the neck 91. Two fixing arms 94 extending toward the side far from the cable connector are respectively provided on both sides of the metal housing 9 and both sides of the neck 91.

The board-end conductive terminal group 8 includes the conductive plastic strip 81, the third conductive terminal group 82, and the fourth conductive terminal group 83. The board-end insulating main body 7 is provided with the insulating plug board 72 inside the second plug slot 71. The conductive plastic strip 81 is installed inside the insulated plug board 72 in an embedded manner. The third conductive terminal group 82 and the fourth conductive terminal group 83 are respectively arranged at the upper surface and the lower surface of the insulating plug board 72. The height of the insulating plug board 72 is less than or equal to the height of the first plug slot 120. A gap for inserting the side wall of the insertion portion 12 is formed between the insulating plug board 72 and the side wall of the board-end insulating main body 7. The board-end conductive terminal group 8 is inserted into the first plug slot 120 so that the first conductive terminal group 21 and the second conductive terminal group 22 are in contact with the third conductive terminal group 82 and the fourth conductive terminal group 83, respectively.

As shown in FIG. 13, the third conductive terminal group 82 and the fourth conductive terminal group 83 are respectively formed by alternately arranging the ground terminal 801 and a signal terminal pair in order, and the signal terminal pair is composed of two mutually symmetrical signal terminals 802. All the ground terminals 801 are electrically connected to the conductive plastic strip 81.

Preferably, the width A of the ground terminal 801 is greater than or equal to the width B of the signal terminal 802, and the gap a between the ground terminal 801 and the signal terminal 802 is greater than or equal to the gap b between the two signal terminals 802.

The distance between the bottom of the front end of the buckle portion 13 and the top of the insertion portion 12 is greater than or equal to the thickness of the top board of the board-end insulating main body 7, so that when the insertion portion 12 is inserted into the second plug slot 71, the top board of the board-end insulating main body 7 can be inserted into the gap formed between the buckle portion 13 and the insertion portion 12. The height of the second limit slot 102 between the bottom of the insertion portion 12 and the top of the guide positioning post 14 is greater than or equal to the thickness of the bottom board of the board-end insulating main body 7, so that when the insertion portion 12 is inserted into the second plug slot 71, the bottom board of the board-end insulating main body 7 can be inserted into the second limit slot 102 formed between the insertion portion 12 and the guide positioning post 14. The distance between the insulating plug board 72 and the side wall of the board-end insulating main body 7 is greater than or equal to the thickness of the side wall of the insertion portion 12, so that the two side walls of the insertion portion 12 can be inserted into the gaps between the insulating plug board 72 and the side walls of the board-end insulating main body 7.

The working principle of the present invention is:

Assembling the connector assembly: after assembling the cable-end connector, the position is aligned, the insertion portion 12, the buckle portion 13, and the two guide positioning posts 14 of the cable-end connector are respectively inserted into the second plug slot 71, the neck 91, and the two guide holes 92 of the board-end connector, the two guide positioning posts 14 can guide the insertion of the entire cable-end connector and prevent the product from being twisted or skewed by a force. At the same time, the insulating plug board 72 on the board-end connector is inserted into the first plug slot 120 of the insertion portion 12 of the cable-end connector, the third conductive terminal group is in contact with the first conductive terminal group for conduction, and the fourth conductive terminal group is in contact with the second conductive terminal group for conduction. The two locking protrusions 521 on the top of the cable-end connector are snapped into the two locking holes 93 of the board-end connector to achieve fixing.

Disassembling the connector assembly: the pressing portion 53 of the buckle 5 is pressed to move downward, the elastic portion 52 moves downward following the pressing portion 53, the two locking protrusions 521 on the top of the elastic portion 52 are separated from the two locking holes 93 of the metal housing 9, the cable connector is pulled to detach from the board-end connector, and the disassembling is completed.

Embodiment 6

Figure 14:
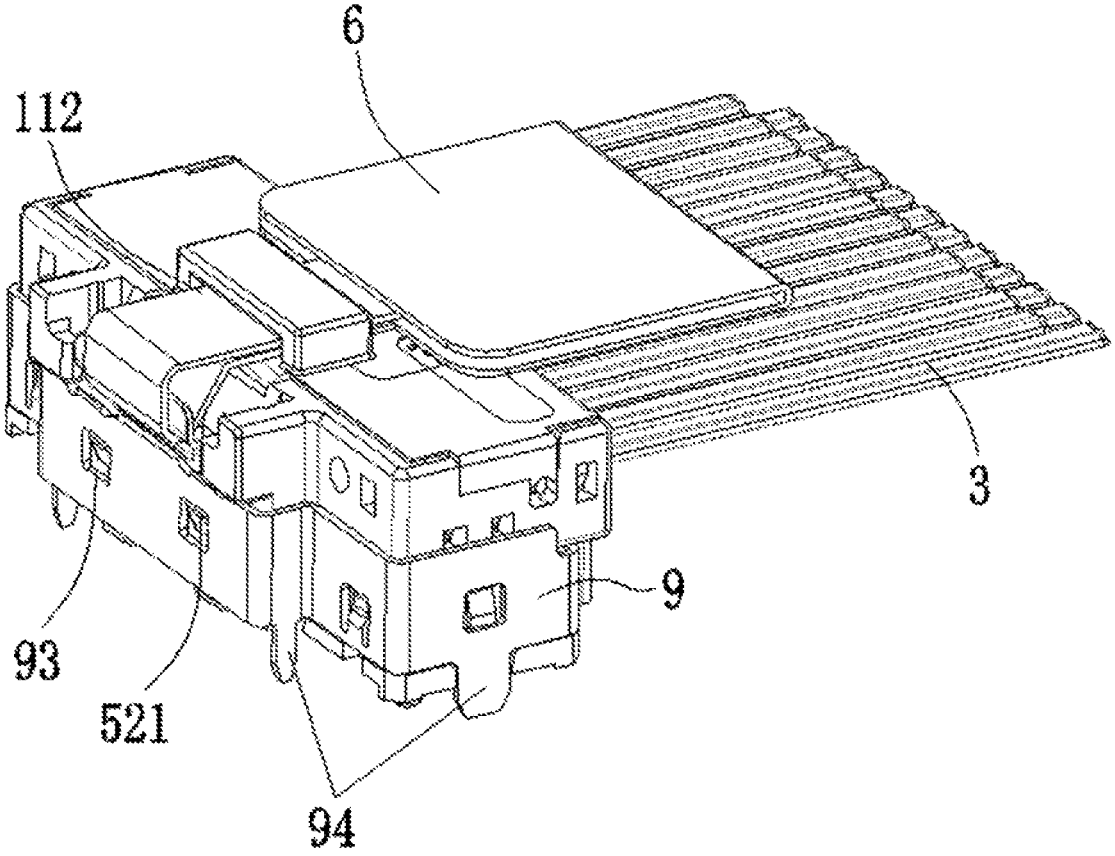
FIG. 14 is a perspective view showing the structure of the connector assembly in Embodiment 6.

As shown in FIG. 14, a connector assembly includes a cable connector and a board-end connector. The cable connector is the cable connector in Embodiment 2. The structure of the board-end connector in this embodiment is the same as that in Embodiment 5.

When the connector assembly of this embodiment is disassembled, the drawstring 6 is pulled to drive the pressing portion 53 of the buckle 5 to move downward, the elastic portion 52 moves downward following the pressing portion 53, the two locking protrusions 521 on the top of the elastic portion 52 are separated from the two locking holes 93 of the metal housing 9, the drawstring 6 is continuously pulled to separate the cable-end connector from the board-end connector, and the disassembling is completed.

Embodiment 7

Figure 15:
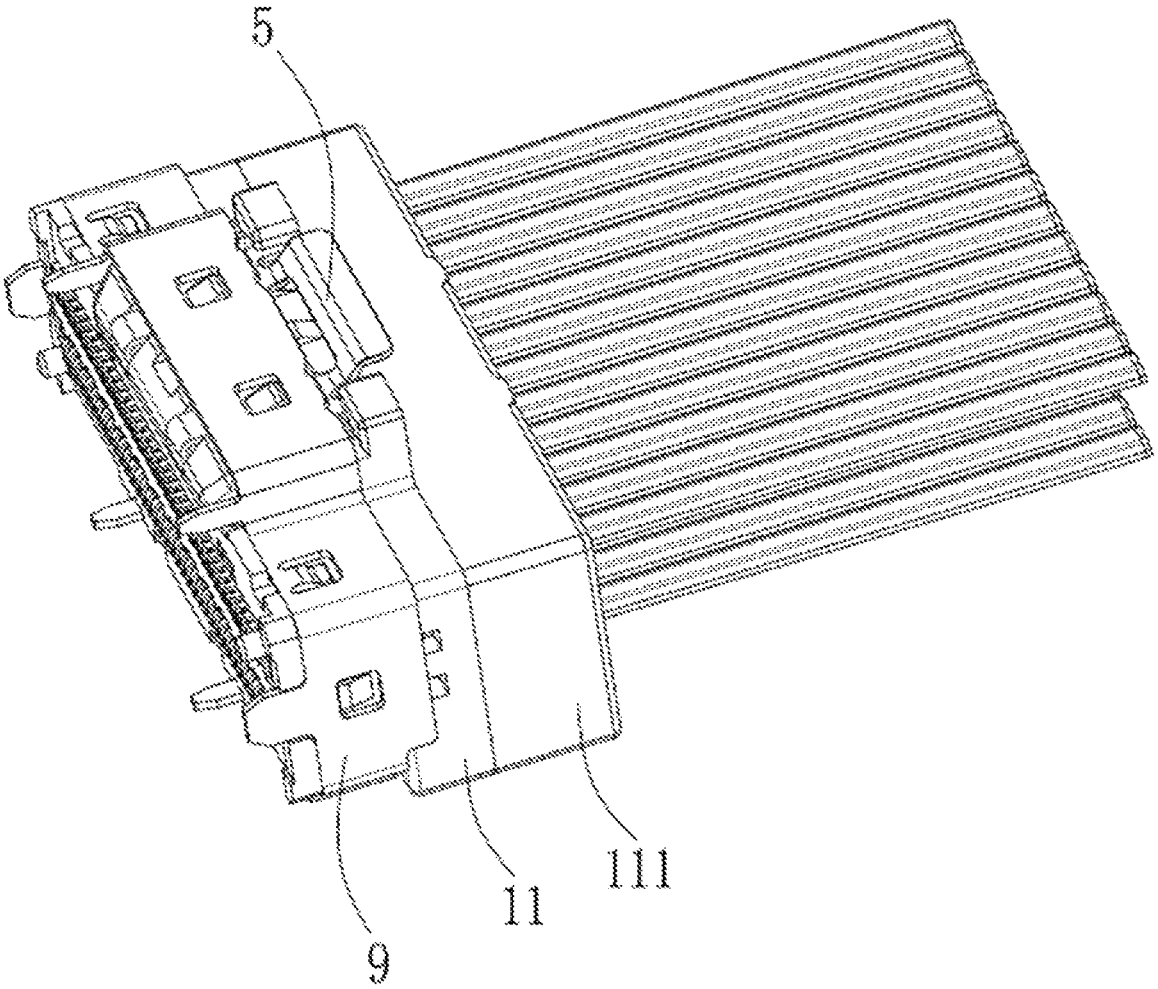
FIG. 15 is a perspective view showing the structure of the connector assembly in Embodiment 7.

As shown in FIG. 15, a connector assembly includes a cable connector and a board-end connector. The cable connector is the cable connector in Embodiment 3. The structure of the board-end connector in this embodiment is the same as that in Embodiment 5.

When the connector assembly of this embodiment is disassembled, the pressing portion 53 of the buckle 5 is pressed to move downward, the elastic portion 52 moves downward following the pressing portion 53, the two locking protrusions 521 on the top of the elastic portion 52 are separated from the two locking holes 93 of the metal housing 9, the cable connector is pulled to detach from the board-end connector, and the disassembling is completed.

Embodiment 8

Figure 16:
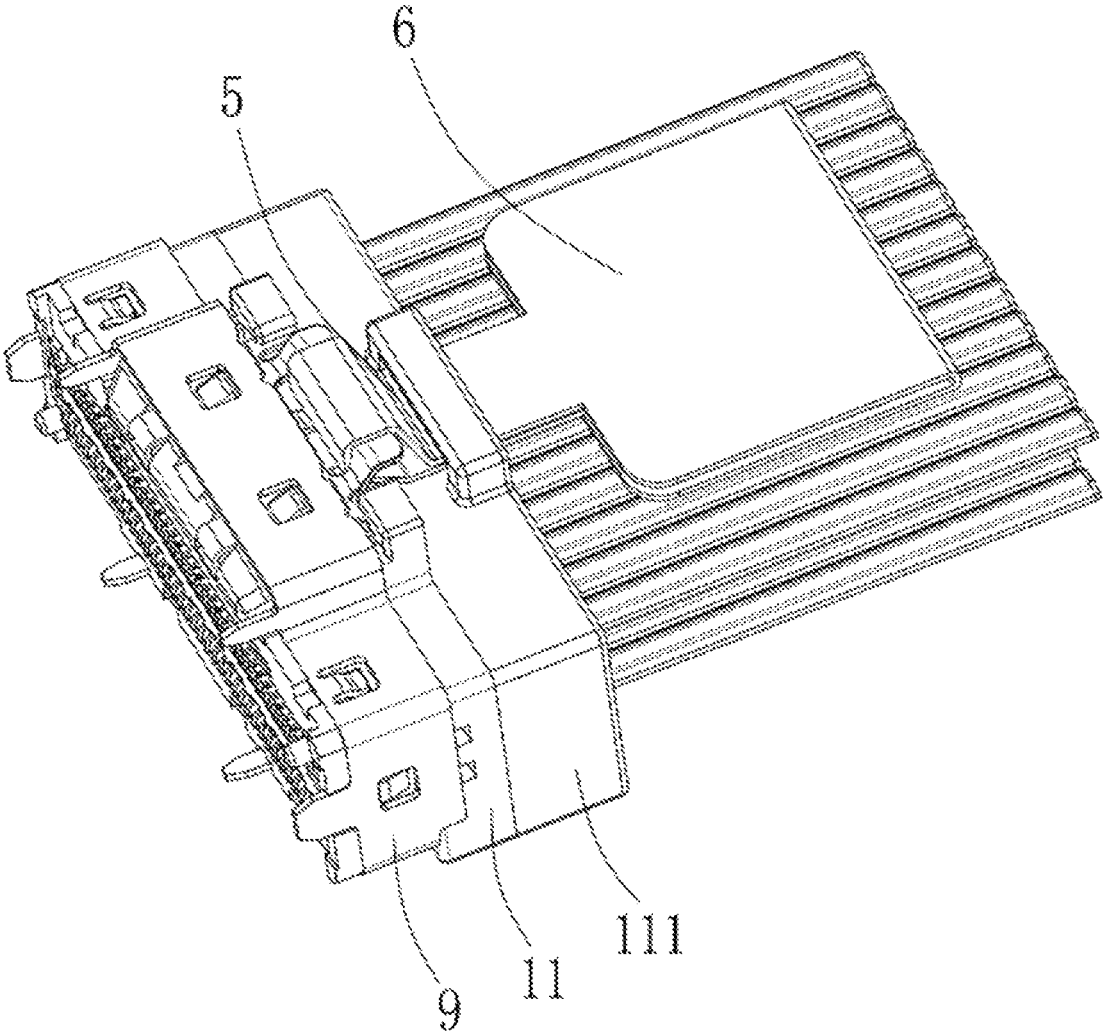
FIG. 16 is a perspective view showing the structure of the connector assembly in Embodiment 8.

As shown in FIG. 16, a connector assembly includes a cable connector and a board-end connector. The cable connector is the cable connector in Embodiment 4. The structure of the board-end connector in this embodiment is the same as that in Embodiment 5.

When the connector assembly of this embodiment is disassembled, the drawstring 6 is pulled to drive the pressing portion 53 of the buckle 5 to move downward, the elastic portion 52 moves downward following the pressing portion 53, the two locking protrusions 521 on the top of the elastic portion 52 are separated from the two locking holes 93 of the metal housing 9, the drawstring 6 is continuously pulled to separate the cable-end connector from the board-end connector, and the disassembling is completed.

Embodiment 9

Figure 17:
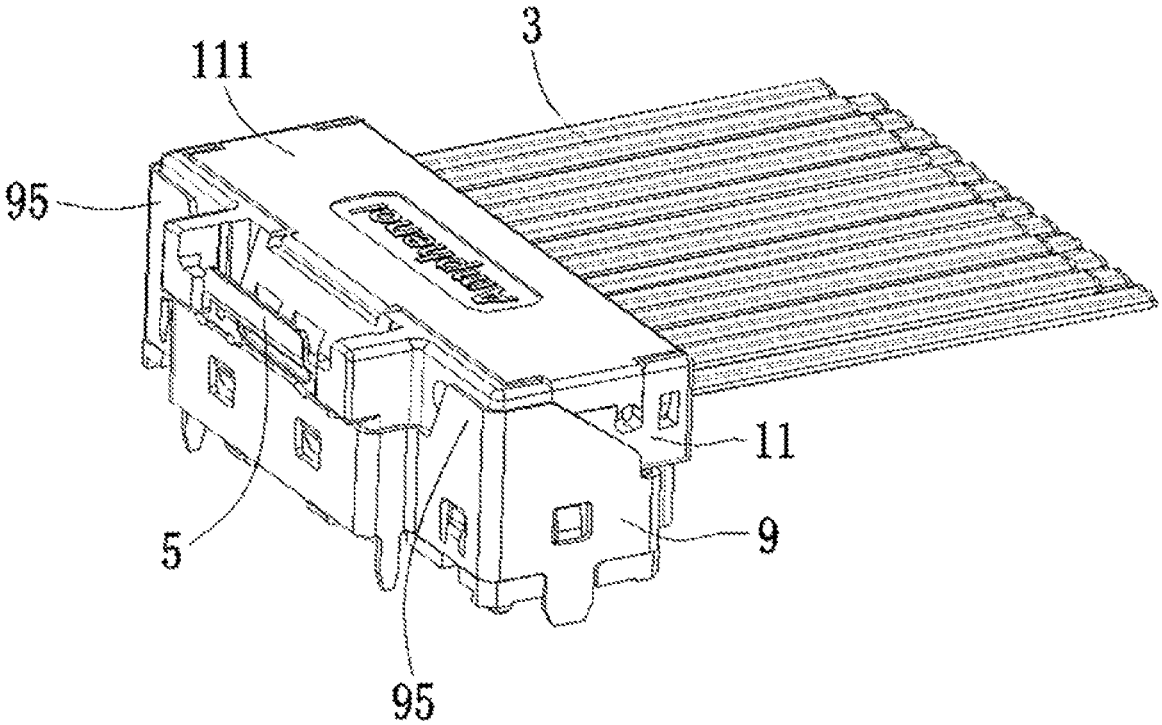
FIG. 17 is a perspective view showing the structure of the connector assembly in Embodiment 9.
Figure 18:
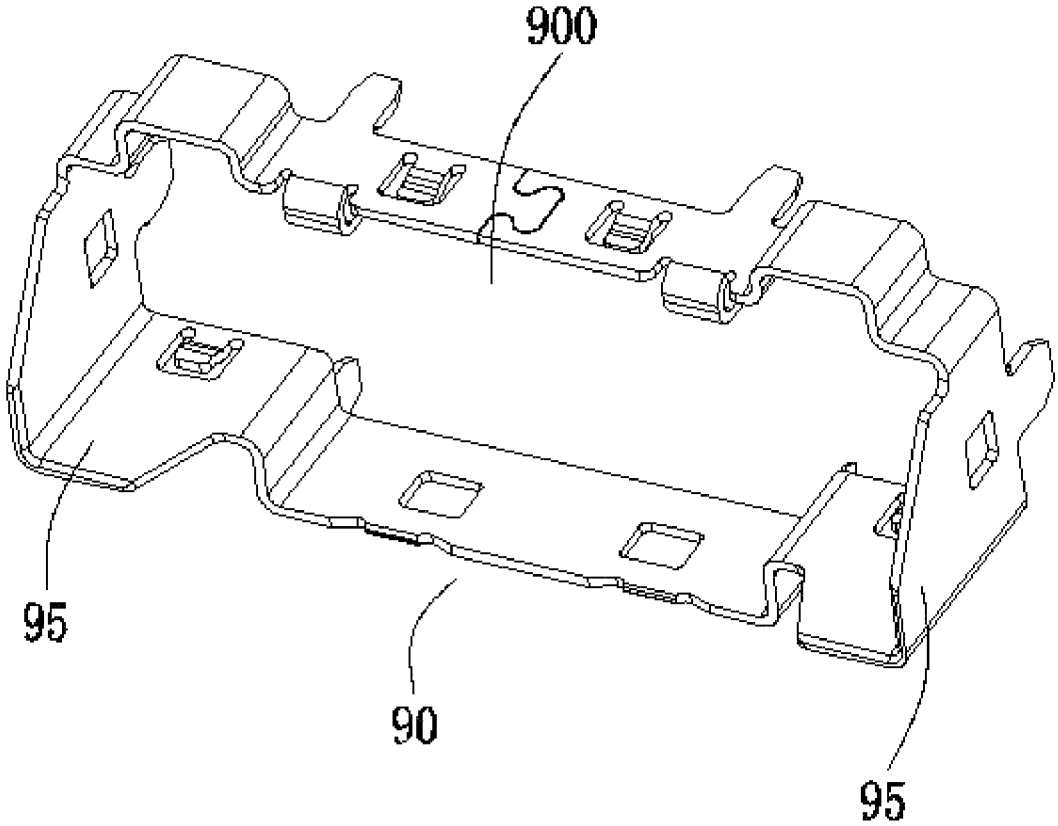
FIG. 18 is a perspective view showing the structure of the metal housing in Embodiment 9.

As shown in FIGS. 17 and 18, a connector assembly includes a cable connector and a board-end connector. The cable connector is the cable connector in Embodiment 1. The differences between this embodiment and Embodiment 5 are only that the two sides of the metal housing 9 respectively extend toward one side of the cable connector to form two L-shaped limit boards 95 for limiting the left and right of the cable connector. The top of the metal housing 9 is formed with the first U-shaped groove 90 at the front end of the neck 91, the rear end of the buckle portion 13 of the cable connector is accommodated in the first U-shaped groove 90, the front end of the bottom of the metal housing 9 is formed with the second U-shaped groove 900, and the main body portion 11 of the cable connector is accommodated in the second U-shaped groove 900. The remaining structures of this embodiment are the same as those of Embodiment 5.

In this embodiment, the heights of the front and back of the metal housing 9 are lower than the heights of the sides of the metal housing 9. This structure can effectively reduce the total height of the product after assembly, and can also improve the contact reliability of the product and prevent the cable connector from shaking left and right.

Embodiment 10

Figure 19:
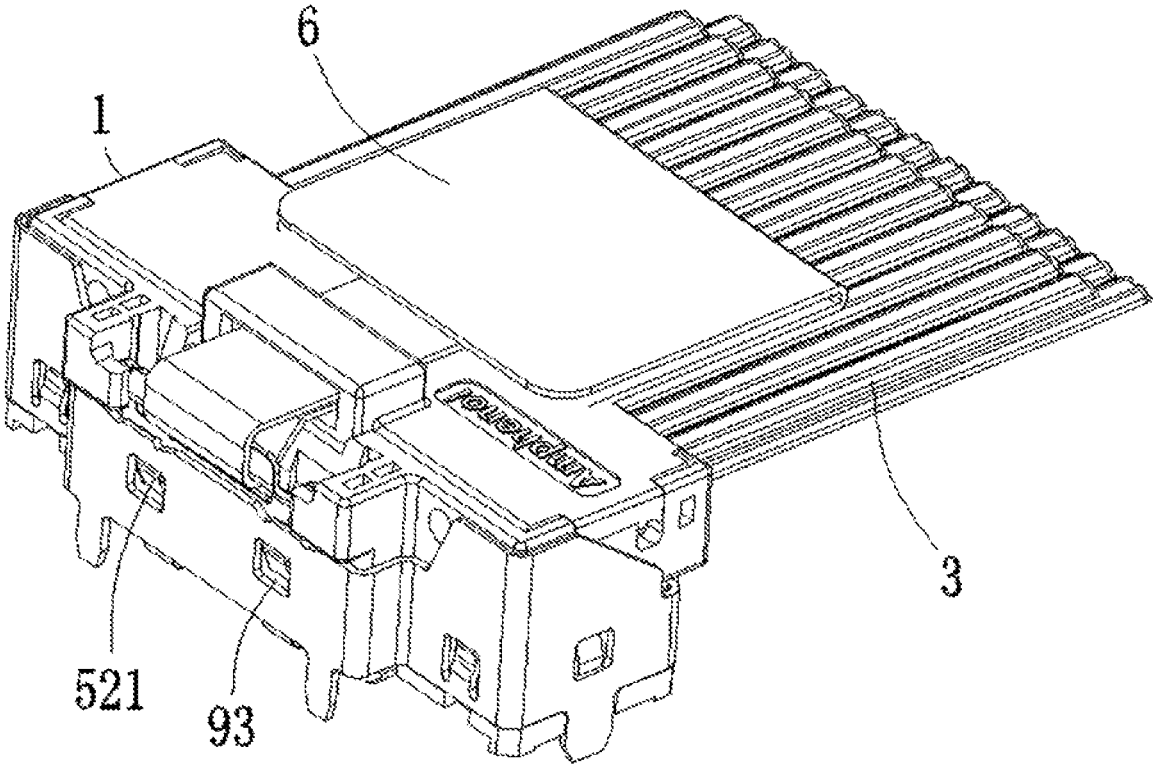
FIG. 19 is a perspective view showing the structure of the connector assembly in Embodiment 10.

As shown in FIG. 19, a connector assembly includes a cable connector and a board-end connector. The cable connector is the cable connector in Embodiment 2. The structure of the board-end connector in this embodiment is the same as that in Embodiment 9.

Embodiment 11

Figure 20:
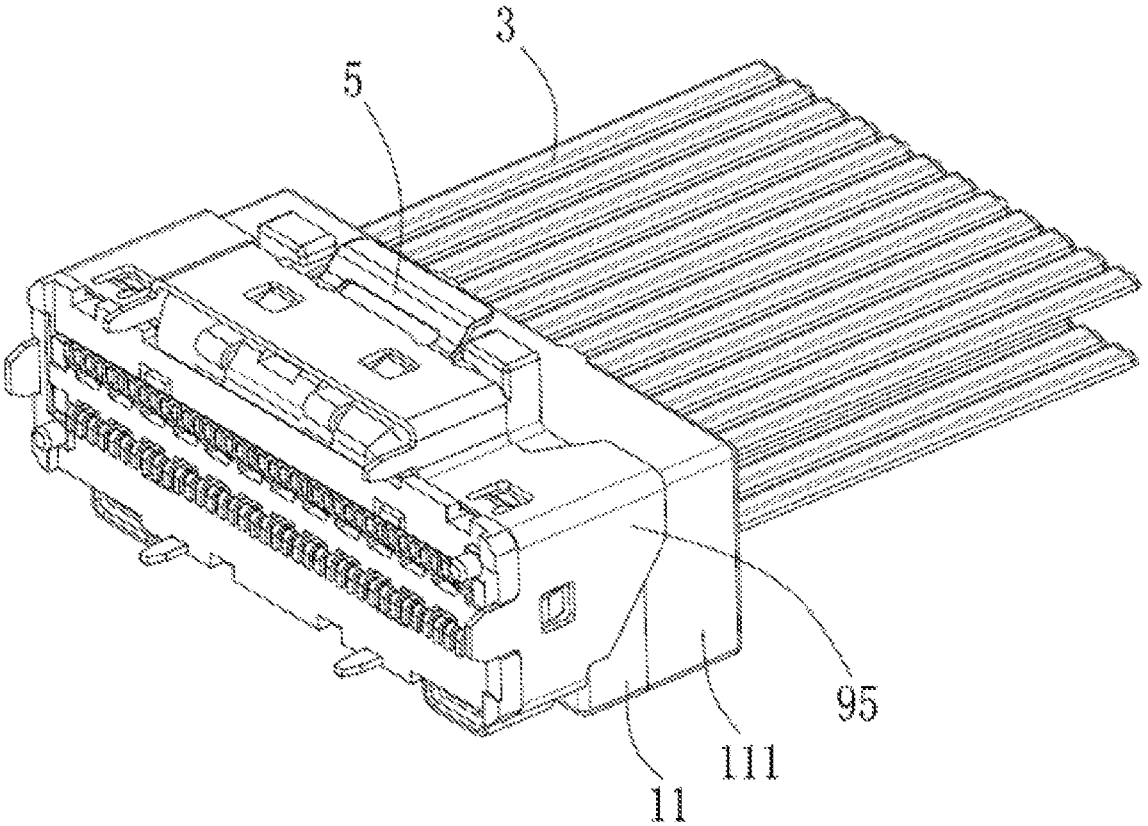
FIG. 20 is a perspective view showing the structure of the connector assembly in Embodiment 11.

As shown in FIG. 20, a connector assembly includes a cable connector and a board-end connector. The cable connector is the cable connector in Embodiment 3. The structure of the board-end connector in this embodiment is the same as that in Embodiment 9.

Embodiment 12

Figure 21:
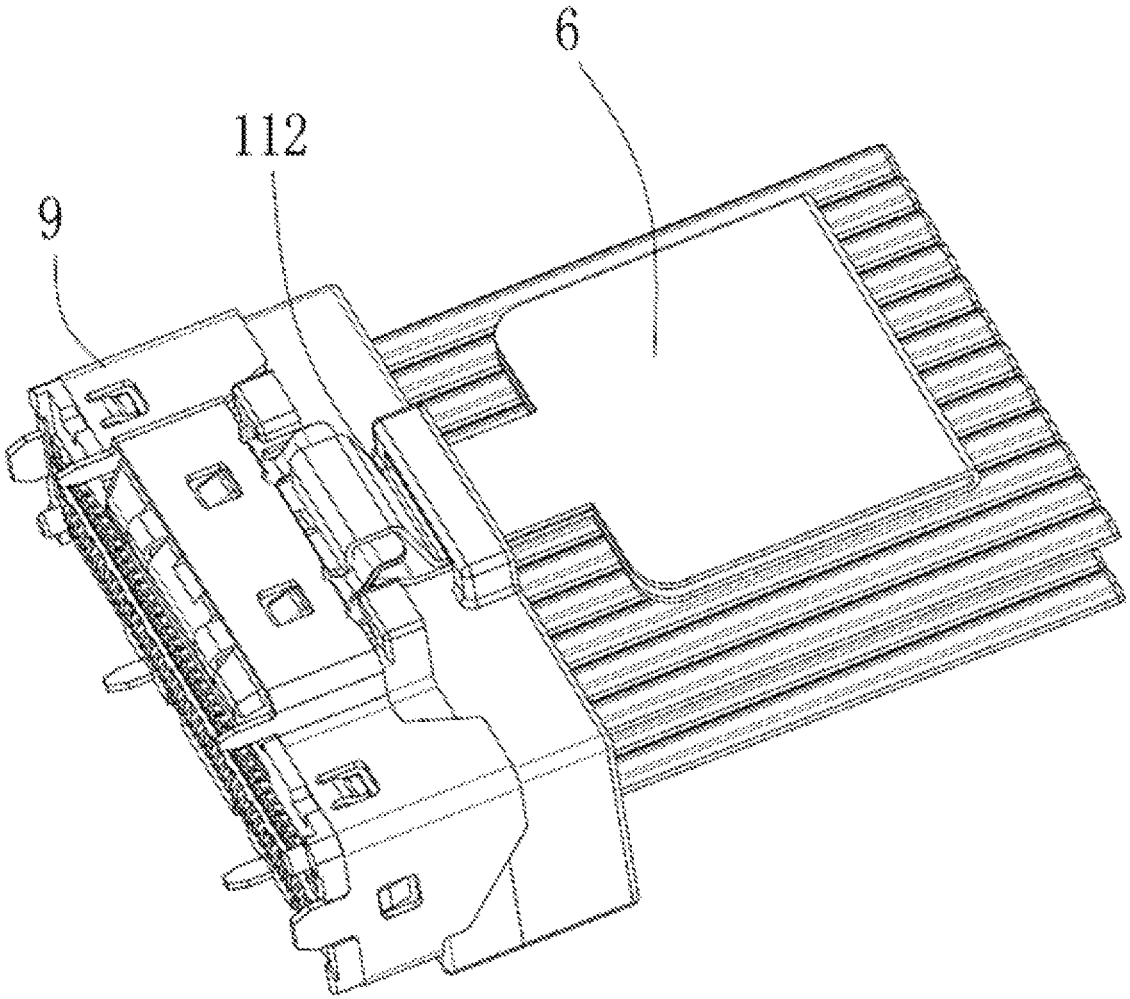
FIG. 21 is a perspective view showing the structure of the connector assembly in Embodiment 12.

As shown in FIG. 21, a connector assembly includes a cable connector and a board-end connector. The cable connector is the cable connector in Embodiment 4. The structure of the board-end connector in this embodiment is the same as that in Embodiment 9.

Although the present invention has been specifically shown and described with reference to the preferred embodiments, those skilled in the art should understand that, without departing from the spirit and scope of the present invention defined in the attached claims, various changes in form and detail made to the present invention are within the protection scope of the present invention.

What is claimed is:

1. A cable connector, comprising:

a cable-end insulating main body, a cable-end conductive terminal group provided inside the cable-end insulating main body, a cable electrically connected to the cable-end conductive terminal group, and a buckle installed above the cable-end insulating main body;

wherein the cable-end insulating main body comprises a main body portion, an insertion portion formed by extending forward from the main body portion, and a buckle portion formed by extending upward and forward from an upper surface of the main body portion;

a buckle slot is provided on a top of the buckle portion, and the buckle is installed in the buckle slot;

a first plug slot is provided in the insertion portion, and the cable-end conductive terminal group is provided in the first plug slot; and a first limit slot is provided between a portion of the buckle portion and the insertion portion, and the portion of the buckle portion extends out the main body portion.

2. The cable connector according to claim 1, wherein the buckle portion protrudes forward beyond the insertion portion.

3. The cable connector according to claim 2, wherein under the insertion portion, two guide positioning posts are formed by extending forward from a front end face of the main body portion, and a second limit slot is provided between the insertion portion and each guide positioning post of the two guide positioning posts.

4. The cable connector according to claim 3, wherein the each guide positioning post protrudes forward beyond the insertion portion.

5. The cable connector according to claim 1, wherein a cavity is provided inside the main body portion, a plastic fixing member for fixing a tail end of the cable-end conductive terminal group is fixedly provided in the cavity, and the cable-end conductive terminal group stretches forward into the first plug slot.

6. The cable connector according to claim 5, wherein the cable-end conductive terminal group comprises a first conductive terminal group and a second conductive terminal group, the first conductive terminal group and the second conductive terminal group are respectively arranged on an upper surface of the first plug slot and a lower surface of the first plug slot, the cable includes a first cable and a second cable, the first cable is parallel to the second cable, the first cable is electrically connected to the first conductive terminal group, and the second cable is electrically connected to the second conductive terminal group.

7. The cable connector according to claim 6, wherein both the first cable and the second cable penetrate backward from a rear end of the main body portion.

8. The cable connector according to claim 6, wherein one end of the first conductive terminal group is connected to the plastic fixing member and bent downward to form a first connection portion, and one end of the second conductive terminal group is connected to the plastic fixing member and bent downward to form a second connection portion, the first connection portion and the second connection portion are provided parallel to each other and staggered back and forth, and both the first cable and the second cable penetrate downward from a bottom of the main body portion.

9. The cable connector according to claim 8, wherein a distance between the first connection portion and the second connection portion is 0.3 mm to 1.5 mm.

10. The cable connector according to claim 1, further comprising a drawstring, wherein the buckle comprises a fixing portion, an elastic portion formed by bending upward from one end of the fixing portion, and a pressing portion formed by obliquely extending upward from a tail end of the elastic portion, an end of the drawstring is connected to the pressing portion.

11. The cable connector according to claim 10, wherein a rear cover is provided at a rear end of the main body portion, a drawstring hole is provided at an upper part of the rear cover, and the end of the drawstring passes through the drawstring hole and is connected to the pressing portion of the buckle.

12. A connector assembly, comprising:

a cable connector, and a board-end connector;

wherein the cable connector is the cable connector according to claim 1.

13. The connector assembly according to claim 12, wherein the board-end connector comprises a board-end insulating main body, a board-end conductive terminal group fixed inside the board-end insulating main body, and a housing sleeved outside the board-end insulating main body; a second plug slot is provided inside the board-end insulating main body, a top of the housing is bent to form a neck, and the insertion portion and a front end of the buckle portion of the cable connector are inserted into the second plug slot and the neck, respectively; and a top board of the board-end insulating main body is inserted into the first limit slot.

14. The connector assembly according to claim 13, wherein an insulating plug board for inserting into the first plug slot is provided inside the second plug slot; the board-end conductive terminal group comprises a conductive plastic strip, a third conductive terminal group, and a fourth conductive terminal group; the conductive plastic strip is installed inside the insulating plug board in an embedded manner, the third conductive terminal group and the fourth conductive terminal group are respectively arranged at an upper surface of the insulating plug board and a lower surface of the insulating plug board, the third conductive terminal group and the fourth conductive terminal group are respectively formed by alternately arranging a ground terminal and a signal terminal pair in order, the signal terminal pair is composed of two mutually symmetrical signal terminals, and the ground terminal is electrically connected to the conductive plastic strip.

15. The connector assembly according to claim 14, wherein a height of the insulating plug board is less than or equal to a height of the first plug slot, and a gap for inserting a side wall of the insertion portion is formed between the insulating plug board and a side wall of the board-end insulating main body.

16. The connector assembly according to claim 13, wherein two fixing arms extending toward a side far from the cable connector are respectively provided on both sides of the housing and both sides of the neck.

17. The connector assembly according to claim 13, wherein two sides of the housing respectively extend toward one side of the cable connector and form two L-shaped limit boards for limiting the left and right of the cable connector.

18. The connector assembly according to claim 13, wherein the top of the housing is formed with a first U-shaped groove at a front end of the neck, a rear end of the buckle portion of the cable connector is accommodated in the first U-shaped groove, a front end of a bottom of the housing is formed with a second U-shaped groove, the main body portion of the cable connector is accommodated in the second U-shaped groove, and the cable connector is completely inserted into the housing.

19. The connector assembly according to claim 13, wherein under the insertion portion, two guide positioning posts are formed by extending forward from a front end face of the main body portion, a bottom of the housing is bent to form two guide holes for inserting the two guide positioning posts, a second limit slot is provided between a bottom of the insertion portion and a top of each of the two guide positioning posts, and a bottom board of the board-end insulating main body is inserted into the second limit slot.

20. The connector assembly according to claim 13, wherein a side and a bottom of the housing are respectively provided with a lockhole and an elastic sheet, and a side and a bottom of the board-end insulating main body are respectively provided with a locking block and an elastic sheet slot for engaging with the lockhole and the elastic sheet in a locking manner.

* * * * *